US006220720B1

(12) United States Patent
Stephens

(10) Patent No.: US 6,220,720 B1
(45) Date of Patent: Apr. 24, 2001

(54) FLASHLIGHT

(75) Inventor: Jeffrey C. Stephens, Robbinsville, NJ (US)

(73) Assignee: Princeton Tectonics, Inc., Bordentown, NJ (US)

( * ) Notice: Subject to any disclaimer, the term of this patent is extended or adjusted under 35 U.S.C. 154(b) by 0 days.

(21) Appl. No.: 09/356,193

(22) Filed: Jul. 16, 1999

(51) Int. Cl.[7] ..... F21L 7/00
(52) U.S. Cl. ..... 362/205
(58) Field of Search ..... 362/202, 203, 362/204, 205

(56) References Cited

U.S. PATENT DOCUMENTS 4,450,508 * 5/1984 Carley ..... 362/203
4,999,750 * 3/1991 Gammache ..... 362/203
5,213,408 5/1993 Shiau ..... 362/187
5,383,104 1/1995 Hou ..... 362/202
5,839,821 * 11/1998 LeZotte ..... 362/208
6,045,236 * 4/2000 Cheng et al. ..... 362/205
6,050,699 * 4/2000 Bouffay et al. ..... 362/203

* cited by examiner

*Primary Examiner*—Sandra O'Shea
*Assistant Examiner*—Peggy C Neils
(74) *Attorney, Agent, or Firm*—Howson & Howson

(57) ABSTRACT

A rotatable head flashlight utilizes a bulb carrier having a circuit board on which are mounted contacts which remain in engagement with energy cells in a battery compartment, a bulb-receiving socket, and a switch assembly engageable with, and operated by, a molded shelf on the inner wall of the battery compartment. The switch includes three contacts, one being a movable contact in the form of a resilient, bridge-like element overlying both of the other contacts, the latter two contacts being printed on the circuit board.

17 Claims, 5 Drawing Sheets

FLASHLIGHT

SUMMARY OF THE INVENTION

This invention relates to flashlights, and particularly to improvements in water-resistant flashlights.

Conventional flashlights typically incorporate sliding switches in the sidewalls of their battery compartments. Such switches are subject to corrosion and wear, and have been notoriously unreliable. Moreover, because they are subject to leakage, they have been generally unsuitable for use in flashlights intended for underwater use.

These drawbacks of conventional flashlight switches have led to the use of rotatable head flashlights in which the battery compartment has no switch and is entirely water-tight, and in which a head, containing an assembly comprising a bulb, a parabolic reflector and a lens, is threaded onto the battery compartment. In rotatable head flashlights, switching is accomplished by rotation of the head relative to the battery compartment. Rotation of the head on the threads of the battery compartment causes the head to move axially, bringing contacts together, or separating them, depending on the direction of movement of the head. A water-tight seal is maintained between the head and the battery compartment, usually by an O-ring or other suitable sealing device. In some cases one of the contacts is a metal portion of the bulb itself. In others a battery terminal or a part of the battery case is used as one of the contacts. The use of portions of the bulb or portions of a battery or battery case as contacts has the advantage of reducing cost, but sometimes produces unreliable operation. Various other switching devices designed for cost reduction also give rise to a risk of unreliable operation. Still others utilize more complex head assemblies in the interest of reliability.

Reliability is, of course, an especially important consideration in underwater flashlight design, and an important object of this invention is to provide an inexpensive, water-resistant flashlight having a highly reliable switch.

The flashlight in accordance with the invention comprises a battery compartment having first and second opposite ends, and an internal space for containing an electrical energy source having a pair of terminals. The compartment is entirely closed except for a opening at one of the opposite ends, and has threads adjacent the opening. A head assembly, including a lens, has threads engaged with the threads of the battery compartment and provides a fluid-tight closure for the opening of the battery compartment. The operation of the threads moves the head assembly axially relative to the battery compartment as it is rotated. A bulb carrier assembly, supporting miniature incandescent bulb, is receivable through the opening of the battery compartment. The bulb carrier includes a reflector arranged to direct light generated by the light bulb through the lens. The bulb carrier is engageable by the head assembly and movable axially by the head assembly.

The bulb carrier has a pair of electrical terminals engageable with the terminals of the electrical energy source. The bulb carrier also has a normally open switch comprising at least two contacts one of which is movable relative to the bulb carrier. The contacts of the switch are carried by the bulb carrier, and conductors provide a series circuit through the bulb, the switch and the pair of electrical terminals. The battery compartment includes a surface engageable with the movable contact of the normally open switch, and positioned to urge the movable contact in a direction to close the series circuit when the head assembly moves the bulb carrier axially in a first direction relative to the battery compartment.

In a preferred embodiment of the invention, the carrier includes a printed circuit board on which the conductors are printed, and on which both electrical terminals, and the contacts of the switch, are mounted.

The board optionally has a socket mounted on it, removably receiving, and providing electrical connections to, the bulb. In the preferred embodiment, the switch includes three contacts, the movable contact being a resilient, bridge-like element overlying both of the other contacts. The surface engageable with the resilient element is preferably a molded shelf formed on the interior wall of the battery compartment.

Preferably, a spring in the battery compartment urges an electrical energy source in the battery compartment in a direction such that the terminals of the electrical energy source are continuously held in contact with the pair of electrical terminals of the bulb carrier. The electrical energy source preferably comprises a pair of cells disposed in side-by-side relationship and connected electrically in series.

Interengaging elements on the battery compartment and the bulb carrier may be provided to prevent rotation of the bulb carrier with the head assembly while permitting axial movement of the bulb carrier relative to the battery compartment.

Other objects, details and advantages of the invention will be apparent from the following detailed description when read in conjunction with the drawings.

DETAILED DESCRIPTION

Figure 1:
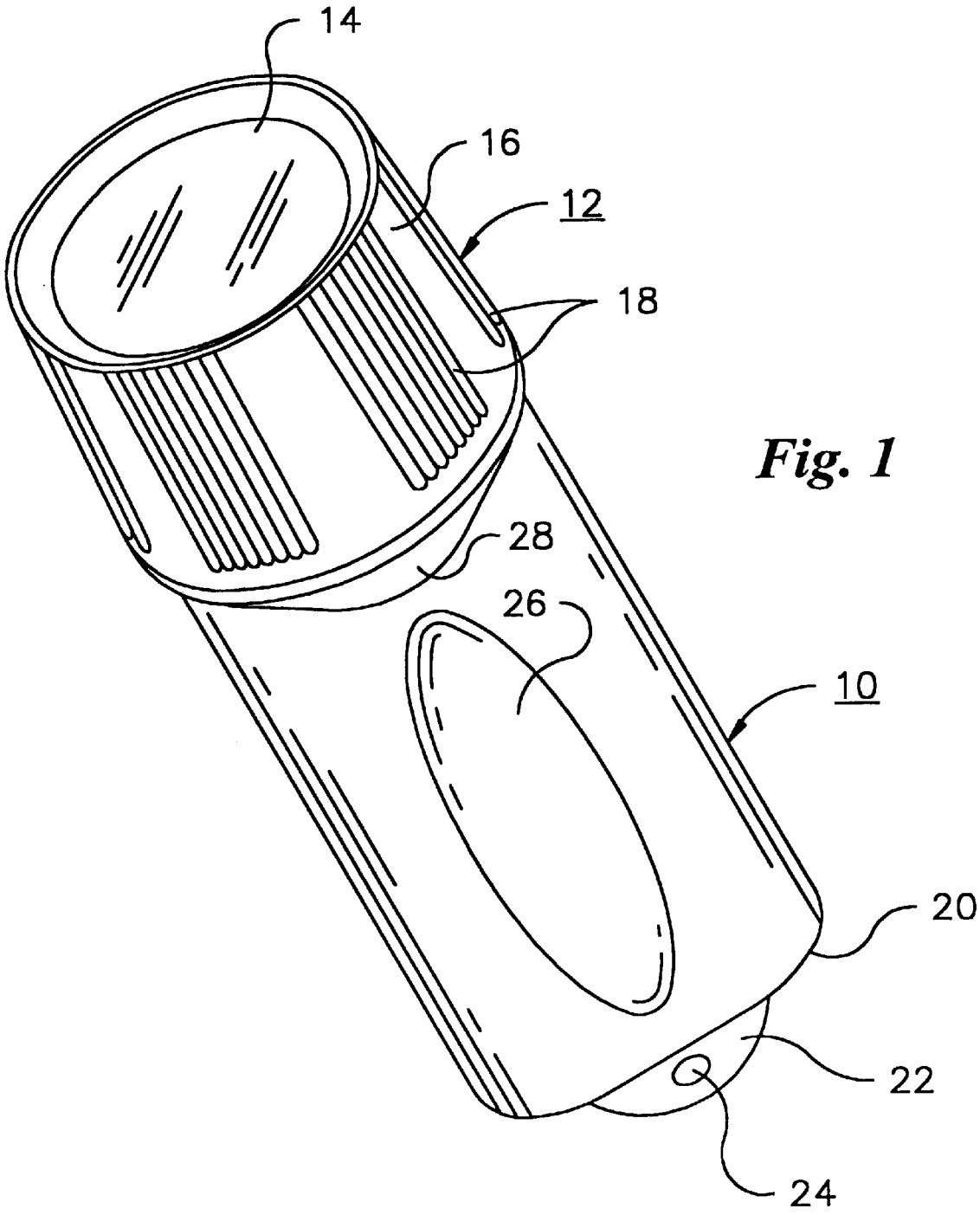
FIG. 1 is a perspective view showing the exterior of a flashlight in accordance with the invention.

As shown in FIG. 1, the flashlight in accordance with the invention comprises a battery compartment 10 and a head assembly 12. The head assembly comprises a lens 14 mounted in a hollow barrel 16, which preferably has ribs 18 to facilitate manual gripping and rotation of the head assembly relative to the battery compartment. The battery compartment 10 is preferably an injection-molded, unitary element having a blind interior terminating in a closed end 20 having an external tab 22 with a hole 24, for connection to a lanyard or the like. The battery compartment is preferably designed to hold two cylindrical 1.5 volt "AAA" cells mechanically in parallel relationship to each other, but electrically in series. Oval-shaped indentations are provided on both sides of the battery compartment to facilitate gripping, one such indentation being shown at 26. The end of the battery compartment adjacent the head assembly is flared at 28.

Figure 2:
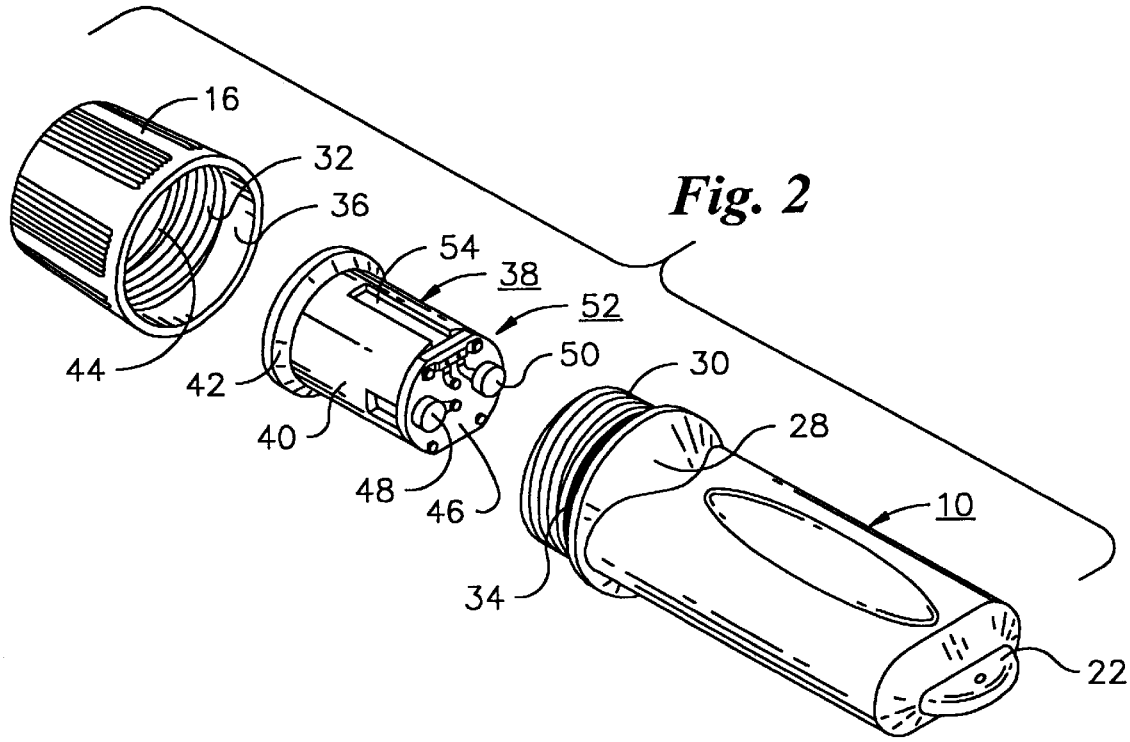
FIG. 2 is an exploded view of the flashlight.

The exploded view of FIG. 2 shows that the battery compartment has an externally threaded extension 30 on the flared part 28, and that the barrel 16 has internal threads 32, which are engageable with the threads on extension 30. The threaded extension 30 is provided with an O-ring 34, which fits a cylindrical inner wall 36 of barrel 16.

Because of the cooperation of the threads, rotation of the head assembly relative to the battery compartment causes the head assembly to move axially relative to the battery compartment through a short distance. The cylindrical inner wall 36 of the barrel 16 slides on O-ring 34, while compressing the O-ring to maintain a water-tight seal.

The flashlight also includes a bulb carrier assembly 38, which preferably comprises a molded body 40 with a flared end 42 which is engageable with an annular surface 44 inside the head assembly. A printed circuit board 46 is mounted at the opposite end of bulb carrier assembly,38. The circuit board carries, on the side visible in FIG. 2, a pair of contacts 48 and 50, and a switch 52. A bulb-receiving socket (not shown in FIG. 2) is mounted on the opposite side of the circuit board. The bulb carrier assembly includes a parabolic reflector (not shown in FIG. 2), which can be a metallized inside surface of molded body 40. A slot 54, extending in the longitudinal direction of the flashlight, is formed on the outer surface of the bulb carrier assembly.

Figure 3:
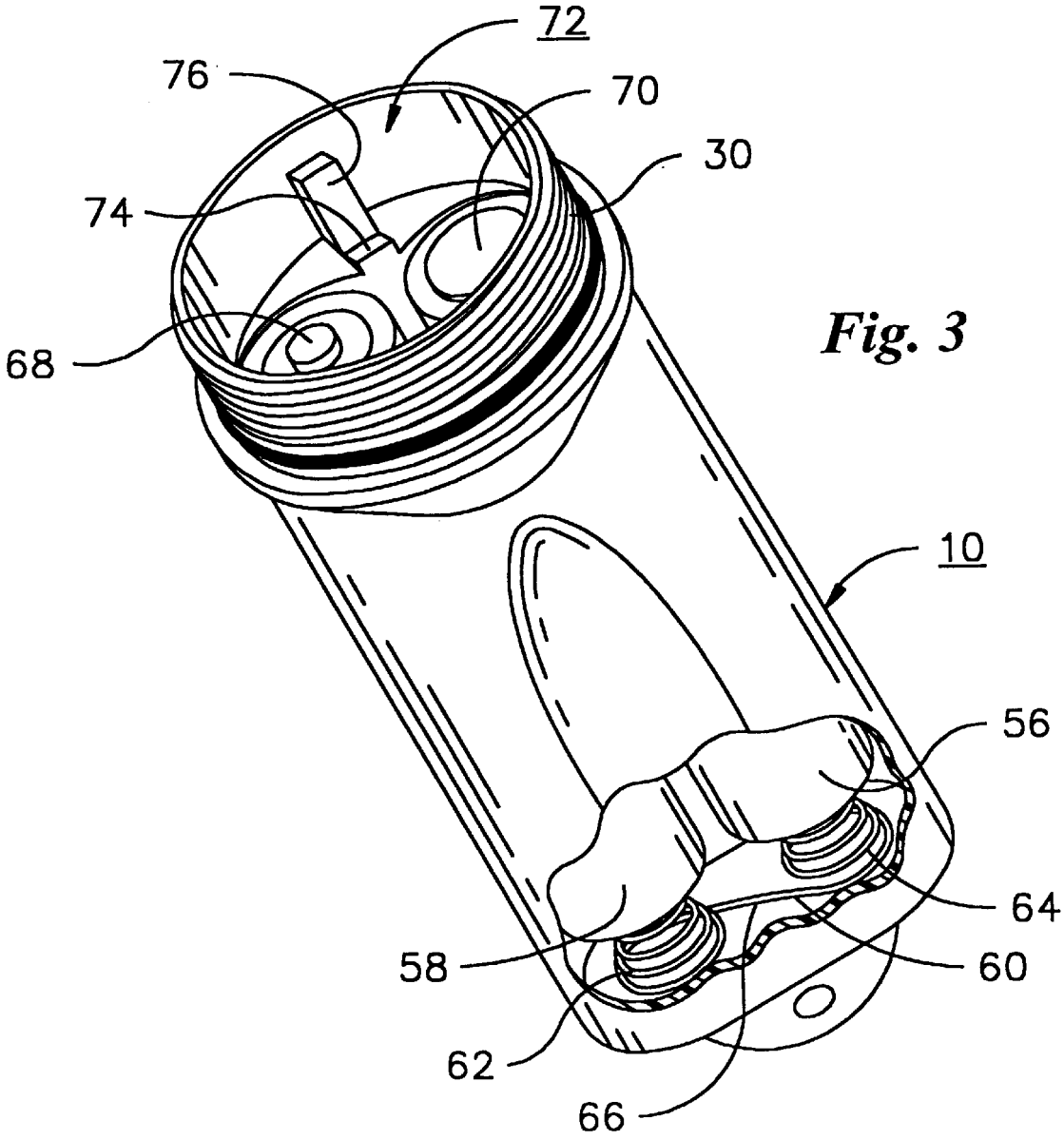
FIG. 3 is a partially broken away view of the battery case portion of the flashlight.

FIG. 3 shows the battery compartment 10 with an electrical energy source consisting of two type "AAA" cells 56 and 58, arranged mechanically in parallel relationship to each other, and connected electrically in series through a spring 60 inside the battery compartment. The spring consists of a single wire wound into two coils 62 and 64, connected to each other by an interconnection 66. The positive terminal 68 of cell 58 and the negative terminal 70 of cell 56 are exposed through the opening 72 in externally threaded extension 30. The springs not only make the series electrical connection between the cells, but also allow for axial movement of the cells while their series connection between terminals 48 and 50 (FIG. 2) is maintained.

As shown in FIG. 3, the interior of the battery compartment has formed on it a small, shelf surface 74, which, as will be seen, is engageable by an element of switch 52. A molded key 76 extends axially from the location of the shelf surface 74 along the inner wall of extension 30. This molded key 76 slides in slot 54 and the cooperation of key 76 and slot 54 prevents rotation of the bulb carrier 38 while allowing the bulb carrier to move axially. In a practical flashlight in accordance with the invention, the interior of the battery compartment will have two shelf surfaces directly opposite each other and two molded keys also directly opposite each other. With this construction, the bulb carrier can be inserted in either of two orientations, 180° apart.

Figure 4:
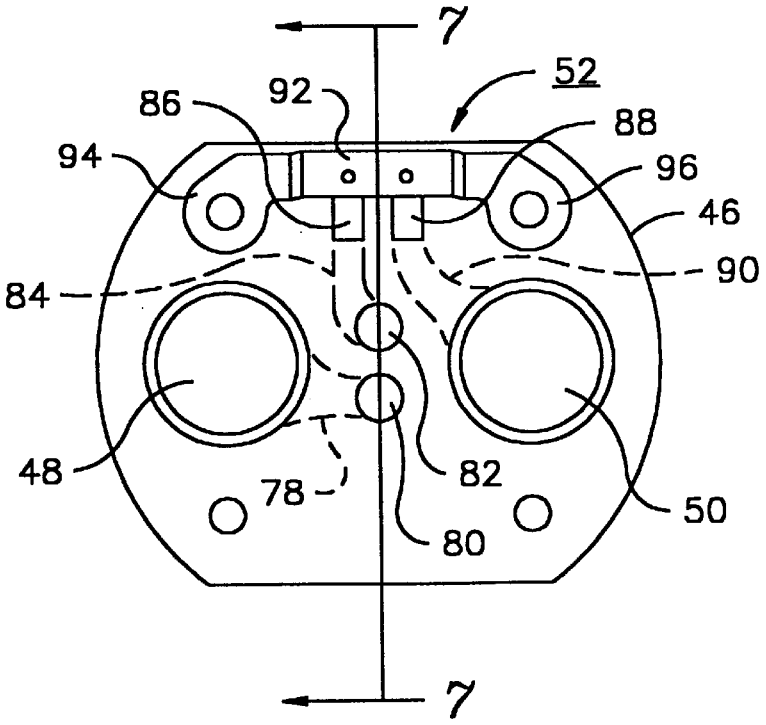
FIG. 4 is an plan view showing details of the circuit board on the bulb carrier assembly, including the battery-contacting terminals and the switch.
Figure 5:
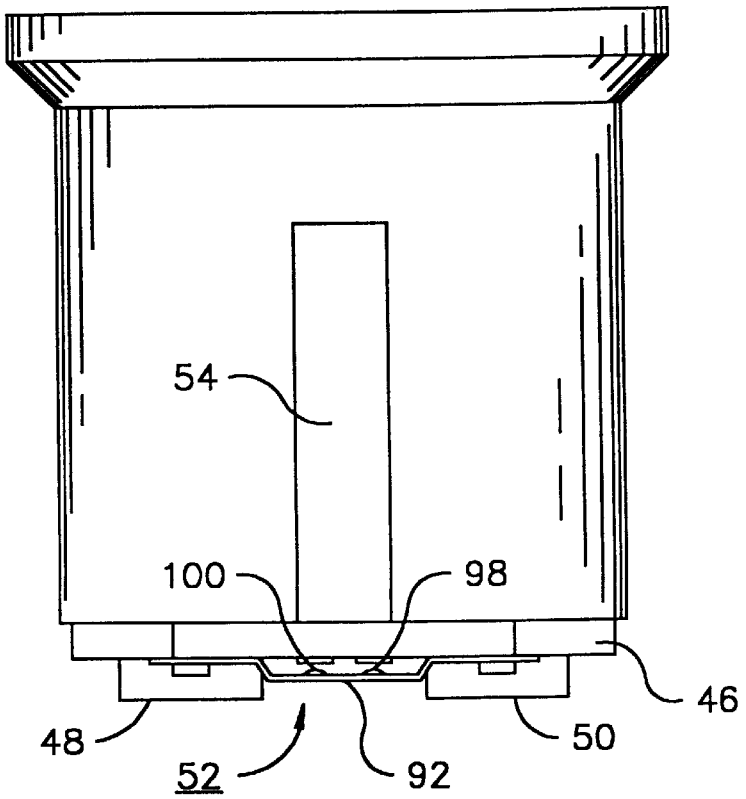
FIG. 5 is an elevational view of the bulb carrier assembly.

FIGS. 4 and 5 illustrate details of the circuit board 46 and switch 52. Contact 48, which engages terminal 70 of cell 56, is connected by conductor 78 to bulb socket terminal 80. The other bulb socket terminal 82 is connected through conductor 84 (which is on the side of the board opposite to the side shown in FIG. 4) to a printed switch contact 86. Contact 50 is connected to a printed switch contact 88 through conductor 90.

Switch contacts 86 and 88 are normally disconnected from each other, but can be electrically connected together by a third contact in the form of a resilient spring metal bridge 92, which is anchored to the circuit board at 94 and 96. The bridge 92 overlies both contacts 86 and 88, and has dimples 98 and 100, which are positioned so that they touch contacts 86 and 88 respectively when bridge 92 is flexed by a force exerted on it by shelf surface 74 (FIG. 3).

Figure 6:
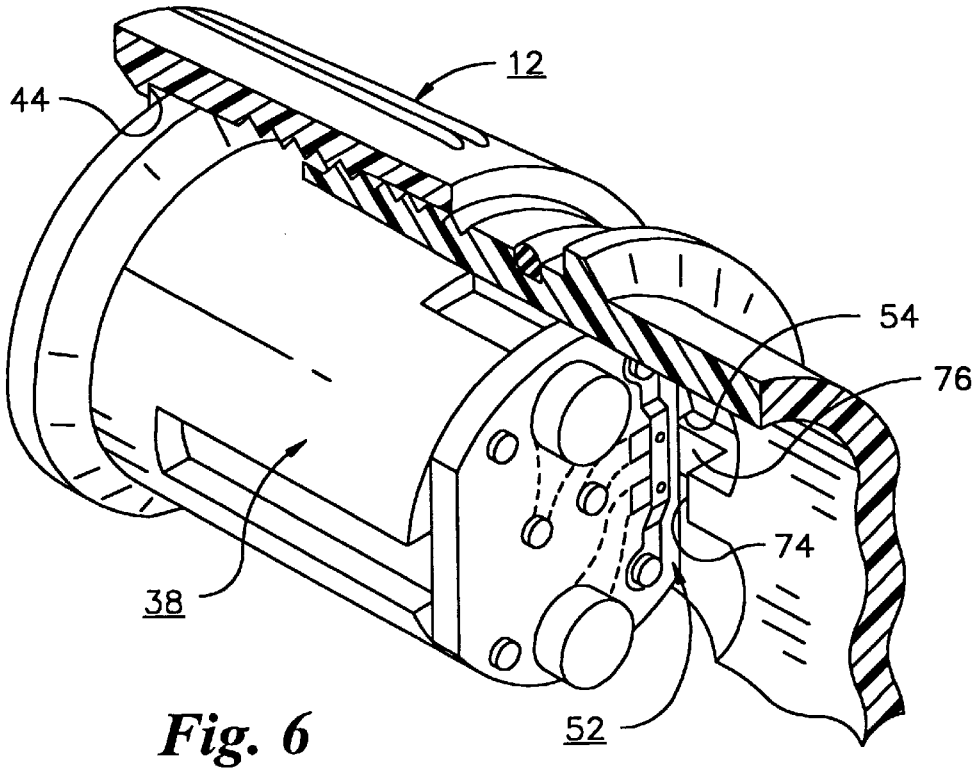
FIG. 6 is a broken-away perspective view showing the bulb carrier assembly in the battery case, and illustrating the operation of the switch.

The manner in which the surface 74 approaches the bridge of switch 52 is best shown in FIG. 6. This figure also shows the key 76, which extends into slot 54 to prevent the bulb assembly from rotating as the head assembly 12 is rotated.

Figure 7:
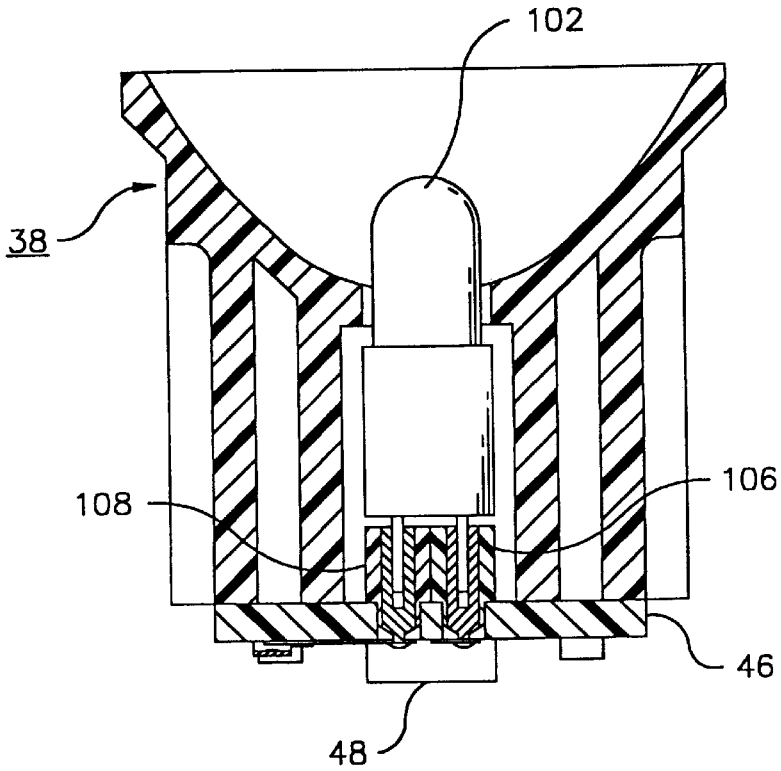
FIG. 7 is a sectional view of the bulb carrier taken on plane 7—7 in FIG. 4.

FIG. 7 shows the bulb carrier 38, with the two pins of a bulb 102 removably inserted into socket connectors 106 and 108 on the side of the circuit board opposite to the side on which contacts 48 and 50 are located.

In operation, the circuit to the bulb is completed by twisting the head assembly clockwise, causing the bulb carrier to be pushed axially by annular surface 44 toward the blind end 20 of the battery compartment. The springs 62 and 64 allow the energy cells 58 and 56 to move axially as the bulb carrier is pushed, and at the same time maintain contact between energy cell terminal 68 and circuit board contact 50 and between energy cell terminal 70 and circuit board contact 48. Shelf surface 74 presses on bridge 92 of switch 52, closing the switch. By virtue of its use of a circuit board-mounted switch, the flashlight of the invention operates with high reliability, there being no use of an element of the bulb itself as a switch contact, and no use of cooperating switch elements mounted respectively on the battery compartment and on the head assembly. The flashlight is simple to manufacture, as all of the electrical switching parts, bulb socket elements and energy cell contacts are circuit-board mounted.

Although the circuit board-mounted switch can consist of one fixed contact and one resilient, movable contact, preferably the switch is a three-contact switch comprising two fixed contacts on the circuit board and an overlying, bridge-like, resilient element arranged to be urged into contact with both of the fixed contacts. The bridge-like element improves the reliability of opening of the switch.

Various modifications can be made to the flashlight described. For example, the battery compartment can be designed to hold a single energy cell, such as a "C" or "D" type cell, in which case one of the energy cell contacts on the circuit board may be centered on the board, and a conductor may be provided in the battery compartment to extend one of the energy cell terminals to a location such that it engages another energy cell contact appropriately positioned on the circuit board. alternatively, the battery compartment can be sized to hold "AA" cells, or elongated so that it can hold more than two cells, for example four "AAA" cells connected in series in a two-by-two arrangement.

Although, in the embodiment described, the bulb is mounted removably in a socket on the circuit board, the pins of the bulb can be instead soldered directly to conductors on the circuit board, in which case the circuit board can be replaced along with the bulb, when the bulb filament burns out. If the circuit board is permanently attached to the reflector, the entire bulb carrier assembly can be replaced.

Still other modifications may be made to the apparatus and method described above without departing from the scope of the invention as defined in the following claims.

What is claimed is:

1. A flashlight comprising:

a battery compartment having first and second opposite ends, and an internal space for containing an electrical energy source having a pair of terminals, the compartment being entirely closed except for a opening at one of the opposite ends, and having threads adjacent the opening;

a head assembly comprising a lens, the head assembly having threads engaged with the threads of the battery compartment and providing a fluid-tight closure for the opening of the battery compartment, the head assembly being rotatable on an axis and movable, by the threads as it is rotated, relative to the battery compartment along the axis;

a light bulb; and a bulb carrier assembly, supporting the light bulb and receivable through the opening of the battery compartment, the bulb carrier including a reflector arranged to direct light generated by the light bulb through the lens of the head assembly;

in which the bulb carrier is engageable by the head assembly and movable thereby along the axis;

in which the bulb carrier has a pair of electrical terminals engageable with the terminals of the electrical energy source, a normally open switch comprising at least two contacts, one of which is movable relative to the bulb carrier, and all of which are carried by the bulb carrier, and conductors connected to provide a series circuit through the bulb, the switch and the pair of electrical terminals; and in which the battery compartment has an interior wall and includes a molded shelf formed on the interior wall of the battery compartment, the molded shelf being engageable with the movable contact of the normally open switch and positioned to urge the movable contact in a direction to close the series circuit when the head assembly moves the bulb carrier in a first direction, along the axis, relative to the battery compartment.

2. A flashlight according to claim 1, in which the bulb carrier includes a printed circuit board, and in which both terminals of the pair of electrical terminals are located on, and fixed to, the printed circuit board.

3. A flashlight according to claim 1, in which the bulb carrier includes a printed circuit board, and in which the contacts of the switch are mounted on the printed circuit board.

4. A flashlight according to claim 1, in which the bulb carrier includes a printed circuit board, in which both terminals of the pair of electrical terminals are located on, and fixed to, the printed circuit board, in which the contacts of the switch are mounted on the printed circuit board, and in which said conductors are printed on the printed circuit board.

5. A flashlight according to claim 1, in which the bulb carrier includes a printed circuit board, in which both terminals of the pair of electrical terminals are located on, and fixed to, the printed circuit board, in which the contacts of the switch are mounted on the printed circuit board, in which said conductors are printed on the printed circuit board, and including a socket on the printed circuit board removably receiving, and providing electrical connections to, the bulb.

6. A flashlight according to claim 1, in which the bulb carrier includes a printed circuit board, in which the contacts of the switch are mounted on the printed circuit board, and in which one of the contacts is a resilient element partly overlying at least one other one of said contacts.

7. A flashlight according to claim 1, including a spring in the battery compartment for urging an electrical energy source in the battery compartment in a direction such that the terminals of the electrical energy source are continuously held in contact with the pair of electrical terminals of the bulb carrier.

8. A flashlight according to claim 1, including an electrical energy source in the battery compartment, the electrical energy source comprising a pair of cells disposed in side-by-side relationship and connected electrically in series.

9. A flashlight according to claim 1, including interengaging elements on the battery compartment and the bulb carrier for preventing rotation of the bulb carrier with the head assembly while permitting axial movement of the bulb carrier relative to the battery compartment.

10. A flashlight according to claim 1, in which the bulb carrier includes a printed circuit board having conductors thereon, and in which the bulb is fixed to, and carried by, the circuit board and connected to said conductors thereon.

11. A flashlight according to claim 1, in which the bulb carrier includes a printed circuit board, and including a socket on the printed circuit board removably receiving, and providing electrical connections to, the bulb.

12. A flashlight according to claim 1, in which the normally open switch comprises two contacts fixed to the bulb carrier, and in which the movable contact is a resilient contact element overlying both of said two contacts and movable by said surface into contact with said two contacts.

13. A flashlight according to claim 12, in which said resilient contact element is a bridge-shaped contact element having two ends, and fixed at both ends to the bulb carrier.

14. A flashlight according to claim 13, in which the bulb carrier includes a printed circuit board, in which said two contacts are fixed to the printed circuit board, and in which the two ends of the bridge-shaped contact element are also fixed to the circuit board.

15. A flashlight according to claim 1, in which the normally open switch comprises two contacts fixed to the bulb carrier, in which one of said two contacts is connected to the bulb and the other of said two contacts is connected to one electrical terminal of the pair of electrical terminals engageable with the terminals of the electrical energy source, and in which the movable contact is a resilient contact element overlying both of said two contacts and movable by said molded shelf into contact with both of said two contacts.

16. A flashlight according to claim 15, in which said resilient contact element is a bridge-shaped contact element having two ends, and fixed at both ends to the bulb carrier.

17. A flashlight according to claim 16, in which the bulb carrier includes a printed circuit board, in which said two contacts are fixed to the printed circuit board, and in which the two ends of the bridge-shaped contact element are also fixed to the circuit board.

* * * * *